United States Patent [19]

Nauman

[11] Patent Number: 4,913,428

[45] Date of Patent: Apr. 3, 1990

[54] PORTABLE NET TIGHTENING POST ASSEMBLY

[76] Inventor: Earl J. Nauman, 1003 U.S. Rte. 52, Amboy, Ill. 61310

[21] Appl. No.: 294,796

[22] Filed: Jan. 9, 1989

Related U.S. Application Data

[63] Continuation of Ser. No. 776,886, Sep. 17, 1985, abandoned.

[51] Int. Cl.[4] ..... A63B 69/00

[52] U.S. Cl. ..... 273/29 BC; 273/411; 135/118

[58] Field of Search ..... 273/29 BB, 407, 30, 273/29 BG, 411, 29 BC, 181 F, 29 R, 26 A; 119/109; 52/155, 156, 165; 135/118; 248/218.3, 218.4

[56] References Cited

U.S. PATENT DOCUMENTS

| | | | |
|---|---|---|---|
| 906,848 | 12/1908 | Atwell | 273/29 BG |
| 1,224,387 | 5/1917 | Lane | 273/29 BB |
| 1,995,543 | 3/1935 | Kaser | 273/30 |
| 2,480,197 | 8/1949 | Rasmussen | 56/431 |
| 2,569,007 | 9/1951 | Klyce | 273/30 |
| 2,735,394 | 2/1956 | Walpole | 119/109 |
| 3,080,166 | 3/1963 | Clark | 273/407 |
| 3,195,898 | 7/1965 | Respini | 273/181 F |
| 3,328,928 | 7/1967 | Frye | 52/165 |
| 4,040,214 | 8/1977 | Frye | 273/29 BB |
| 4,093,224 | 6/1978 | Hale | 273/29 BB |
| 4,135,716 | 1/1979 | Ginsberg | 273/411 |

FOREIGN PATENT DOCUMENTS

| | | | |
|---|---|---|---|
| 1147177 | 4/1963 | Fed. Rep. of Germany | 52/155 |
| 2550238 | 5/1977 | Fed. Rep. of Germany | 273/29 BB |
| 2837577 | 3/1980 | Fed. Rep. of Germany | 135/118 |
| 1150 | of 1882 | United Kingdom | 273/29 BB |
| 80 | of 1884 | United Kingdom | 273/29 BE |
| 4079 | of 1885 | United Kingdom | 273/29 BD |
| 7097 | of 1885 | United Kingdom | 273/29 BD |
| 1549 | of 1890 | United Kingdom | 135/118 |
| 286787 | 3/1928 | United Kingdom | 273/29 BB |
| 317687 | 11/1929 | United Kingdom | 273/29 BD |
| 571855 | 9/1945 | United Kingdom | 273/29 BB |

*Primary Examiner*—T. Brown

*Attorney, Agent, or Firm*—Frederick R. Handren

[57] ABSTRACT

A portable self-supporting post assembly designed for supporting sports nets, tarpaulins, awnings and the like includes a post anchor with downwardly extending prongs adapted to be imbedded in a penetrable support surface such as sand or soil. The pongs are fastened to a base plate of the post anchor at locations displaced outwardly from a post or pole which extends upwardly from a top surface of the base plate. The prongs are formed of flat spring metal and are outwardly curved to enhance their gripping action in the support surface. The resiliency of the prongs maintains the tautness of a net, tarpaulin, awning or the like which is supported between a pair of the post assemblies.

20 Claims, 2 Drawing Sheets

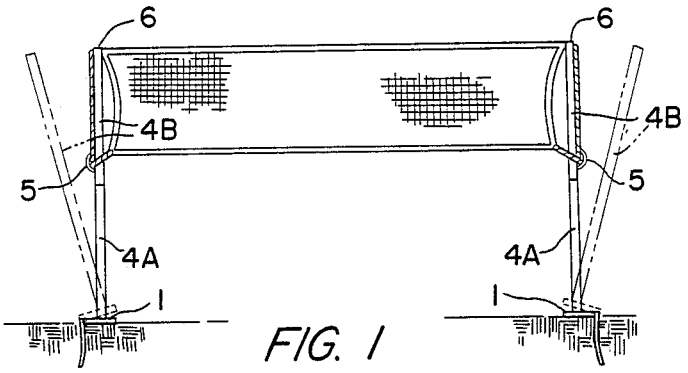
FIG. 1
FIG. 2
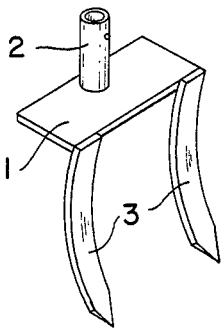
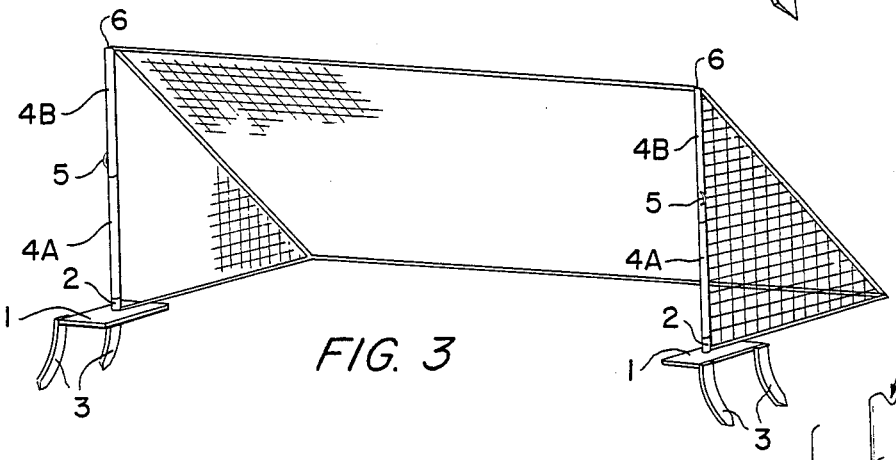
FIG. 3
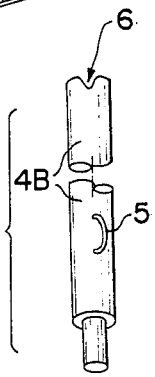
FIG. 4
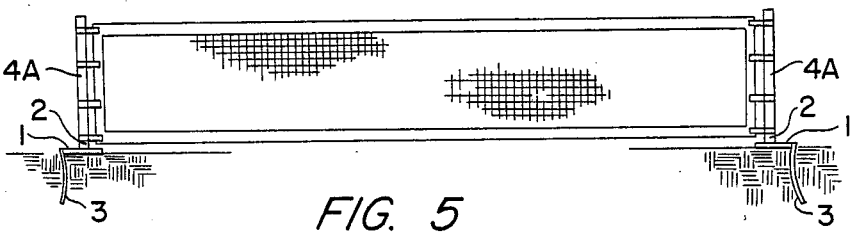
FIG. 5

PORTABLE NET TIGHTENING POST ASSEMBLY

CROSS REFERENCE TO RELATED APPLICATION

This application is a continuation of application Ser. No. 06/776,886 filed Sept. 17, 1985 (ABANDONED).

BACKGROUND OF THE INVENTION

1. Field of the Invention

The present invention relates to portable post assemblies and to portable post anchors employed in such post assemblies. The post assemblies are of particular use in providing support for various kinds of sports nets and for various kinds of tarpaulins and awnings as well.

In the playing of games such as volleyball, it is desirable that reliable support be provided for maintaining the net in a taut condition. One well known means of providing this support is to sink upright posts permanently into the surface on which the game is to be played. Another is to imbed or otherwise anchor the lower ends of upright posts and provide additional support in the form of guy lines or side braces fastened to the posts. It is also well known to attach weighted bases to lower ends of net support posts to hold them in place.

The net supporting arrangements identified above have disadvantages. In the case of the permanently imbedded posts, the game can only be played at the location where the post are installed; the posts cannot be easily moved to another location. The same is true to a lesser extent of the posts with the weighted bases; although they can be set up at a desired location, their weight alone makes transporting them difficult. In the case of net posts which require guy lines or side braces to maintain the tautness of the net, the setup procedure is more involved, and the lines or braces add to the space requirements for the setup and can interfere with the playing of the game.

SUMMARY AND OBJECTS OF THE INVENTION

An object of the present invention is to provide post assemblies which afford reliable support for sports nets, tarpaulins, awnings and the like, which require no guy lines or side braces and which can be easily set up.

Another object of the present invention is to provide a post assembly which can be disassembled to a compact package for convenient transport and storage.

Another object of the present invention is to provide a portable post anchor which is easily installed in sand, soil or some other penetrable support surface and which provides reliable support for an upright post.

The post assembly of the present invention comprises a support post or pole, which may be formed of more than one separable section, and a post anchor joined to the lower end of the support post. The post anchor carries downwardly extending prongs which can be imbedded in a penetrable support surface such as sand or soil. The support post is joined to a base plate of the post anchor adjacent a side edge thereof. The prongs, which are outwardly curved and preferably are formed from flat spring steel stock, are fastened to the base plate at locations which are displaced outwardly from the joint between the base plate and the support post. The curvature and resilience of the imbedded prongs and the displacement between the prongs and the support post act to afford a secure support for the support post and to maintain in a taut condition a net, tarpaulin, awning or the like carried by the support post. Nets for volleyball, soccer, tennis, badminton and football kicking practice and tarpaulins for close golf practice and baseball backstops are among the uses contemplated for the post assemblies of the present invention.

Further understanding of the present invention will be gained from the detailed description provided below and from the accompanying drawings. The specific preferred embodiments which are disclosed should be regarded as illustrative and not restrictive of the scope of the invention, since obvious modifications of these embodiments will occur to persons of ordinary skill in the art having the benefit of this disclosure.

BRIEF DESCRIPTION OF THE DRAWINGS

FIG. 1 shows a volleyball net erected using the post assemblies of the present invention.

FIG. 2 shows details of the post anchor according to the present invention.

FIG. 3 shows the post assemblies of the present invention supporting a soccer goal net.

FIG. 4 shows details of an upper support post section.

FIG. 5 shows the post assemblies of the present invention supporting a tennis net.

DETAILED DESCRIPTION OF THE PREFERRED EMBODIMENTS

As shown in FIG. 1, a sports net, such as one used for the playing of volleyball, is supported between two upright post assemblies constructed according to the present invention. Each of the upright post assemblies includes a post anchor with a generally flat base plate 1 and an upright support post. In this particular embodiment, each support post is formed of a lower support post section **4*a*, which is joined at its lower end to the base plate, and an upper support post section 4*b***, which is joined to the upper end of the lower support post section.

FIG. 2 shows details of a post anchor according to a preferred embodiment of the present invention. Located adjacent an inside edge of the base plate and extending upwardly from a top surface thereof is a post fitting in the form of an upwardly open socket 2 which is adapted to receive the lower end of a separate support post. Extending longitudinally downwardly from the base plate are two prongs 3 which are pointed at their lower free ends to facilitate their penetration into a support surface such as sand or soil. The prongs, which are formed from flat spring steel stock having a lateral cross-section of substantially greater width than thickness, are fastened at their upper ends to the base plate at locations which are displaced outwardly from the location of the post fitting. The prongs are oriented with their broad cross-sectional dimensions extending transversely to the outward direction of displacement of the prong upper ends from the post fitting, and each prong is curved along its length so that the lower free end extends downwardly and outwardly away from the location of the post fitting. In this particular embodiment, the base plate 1 is rectangular, the post fitting is fastened to the top surface of the base plate adjacent one side edge thereof, and the prongs are fastened along an opposite parallel outside edge at locations which are equidistant from the post filling.

Figure 7:
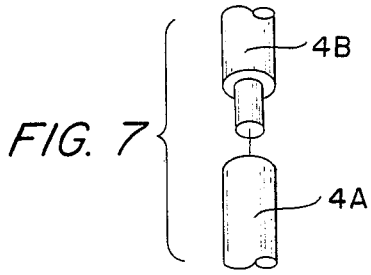
FIG. 7 shows details of a telescopic joint between upper and lower support post sections.

Referring to FIG. 4, the upper support post section 4*b* is shown as having a guide channel 6 formed in its upper end, a loop 5 attached to the post section between its ends and a lower end of reduced dimension. In FIG. 7, the lower end of the upper support post section 4*b* is shown as telescopicaly receivable into and separable from the upper end of the lower support post section 4*a* to enable joining of the two support post sections. The separably joined post sections, in combination with a post anchor having an upwardly open socket to receive the lower end of the lower post section, form a post assembly which is easily disassembled to a compact package for convenient transport and storage. Alternatively, the lower support post section 4*a* can be directly fastened to the base plate as shown in FIG. 1, although the resulting disassembled package will not be as compact.

Again referring to FIG. 4, the upper support post section 4*b* is shown as having a guide channel 6 formed in its upper end and a loop 5 attached to the post section between its ends. As shown in FIG. 1, the guide channel 6 serves to guide and retain the top rope of the net, and the loop 5 serves as a fitting for securing the ends of the top and bottom ropes of the net.

The use of the post assemblies of the present invention to support a sports net such as a volleyball net is illustrated in FIG. 1. The prongs 3 of the post assemblies are forced into the ground at locations spaced apart somewhat wider, two feet wider, for example, than the width of the net. In performing this operation, the installer may apply a foot to the base plate 1 while rocking the post assembly laterally back and forth to aid the insertion of the prongs. Each of the post assemblies is forced into the ground initially at an outward tilt which, due to the curvature of the prongs 3, becomes less pronounced as the prongs reach their full insertion depth. After insertion of the prongs but before securement of the net, the outward-tilted orientation of the post assemblies is as shown in phantom lines in FIG. 1. The top rope at one side of the net is placed in the guide channel 6 at the top of one of the post assemblies, and the end of the rope is tied to the loop 5. Then, at the other side of the net, the top rope is placed in the guide channel 6 at the top of the other post assembly, and tension is applied to the rope. Due to the resilience of the spring steel prongs 3, base plates 1 can flex with respect to the imbedded prongs so that the post assemblies can be drawn toward each other by the rope from their initially outwardly tilted orientations to the upright orientations illustrated in solid lines in FIG. 1. When the upright orientation of the post assemblies is reached, the taut rope is tied to the loop 5 of the other post assembly. To complete the installation, the ends of the bottom rope of the net are tied to the loops 5 of the post assemblies.

In upright orientation of the post assemblies, the base plates contact the ground surface to impeded further inward movement of the post assemblies toward each other while the stresses produced by the flexed position of the base plates about the imbedded prongs maintain the top rope of the net in a taut condition which can yield substantially, as much as three feet, to applied forces, such as those which will occur frequently during the playing of volleyball. The flexed position of the base plates with respect to the imbedded prongs also applies forces to the prongs which, due to their curvature, tend to move them further into the ground to thus enhance their gripping action.

Another application of the post assemblies of the present invention is illustrated in FIG. 3. As shown, the post assemblies are used as supports at the front opening of a soccer goal net.

FIG. 5 illustrates the application of the post assemblies of the present invention to a tennis net. For this particular use, the post assemblies are shown as employing only a lower support post section 4*a*.

Figure 6:
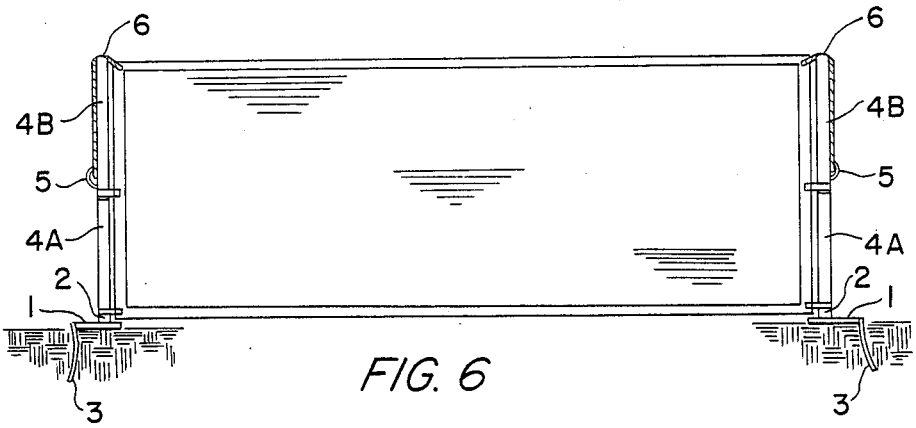
FIG. 6 shows the post assemblies of the present invention supporting a tarpaulin which can serve as a backstop.

In FIG. 6, the post assemblies of the present invention are shown supporting a tarpaulin which can serve as a backstop.

Figure 8:
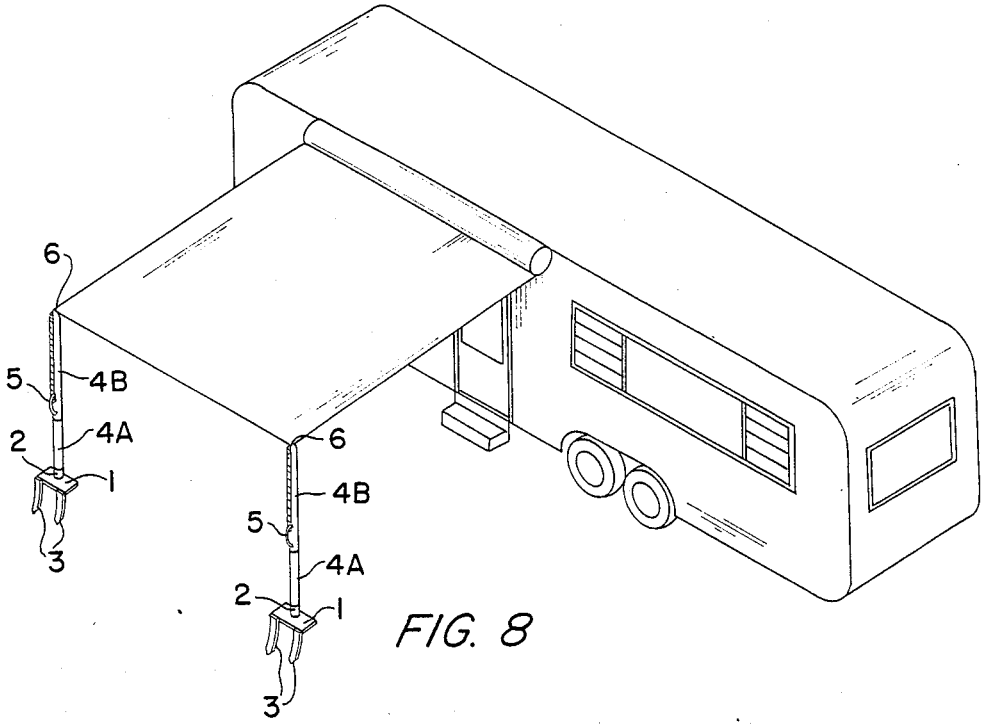
FIG. 8 shows the post assemblies of the present invention supporting an awning.

Another use of the post assemblies of the present invention is illustrated in FIG. 8. Here the post assemblies are used to support the outer corners of an awning attached to a mobile home.

Variations or modifications of the above-described invention which would be obvious to persons of ordinary skill in the art are to be regarded as falling within the scope of the invention as defined in the following claims.

I claim:

1. A portable self-supporting post assembly comprising:

a substantially flat base plate having a top surface, a bottom surface and side edges, including an inside edge and an opposite outside edge, circumscribing said top and bottom surfaces;

a post joined to and extending upwardly from said top surface of said base plate at a location adjacent said inside edge which is substantially closer to said inside edge than said outside edge; and at least one resilient prong having a lateral cross-section of substantially greater width than thickness, said prong having a free first end adapted to penetrate a support surface and a second end rigidly fastened to said base plate at a location displaced a finite distance in an outward direction along the plane of said base plate from the location of said post, said prong being oriented with its width generally transversal to said outward direction and extending longitudinally downwardly from said bottom surface of said base plate and curving smoothly outwardly along a substantial portion of its length so that said free first end thereof extends downwardly and away from the location of said post.

2. A portable self-supporting post assembly as claimed in claim 1, wherein said prong is formed of flat spring metal.

3. A portable self-supporting post assembly as claimed in claim 2, wherein said second end of said prong is rigidly fastened to said outside edge of said base plate.

4. A portable self-supporting post assembly as claimed in claim 1, wherein two of said prongs are provided, and said second ends thereof are spaced from each other in a direction which is transverse to said outward direction.

5. A portable self-supporting post assembly as claimed in claim 4, wherein said prongs are formed of flat spring metal.

6. A portable self-supporting post assembly as claimed in claim 5, wherein said scocnd ends of said prongs are rigidly fastened to said outside edge of said base plate.

7. A portable self-supporting post assembly as claimed in claim 6, wherein said second ends of said prongs are equidistant from where said post is joined to said base plate.

8. A portable self-supporting post assembly as defined in claim 5, wherein said post is joined to said base plate by a post fitting fastened to said base plate.

9. A portable self-supporting post assembly as defined in claim 8, wherein said post fitting is an upwardly open socket and said post is received in said socket.

10. A portable self-supporting post assembly as defined in claim 9, wherein said post comprises an assembly of telescopicaly joined post sections.

11. A portable self-supporting post assembly as defined in claim 9, wherein said post has a free end distal to said base plate, and a guide channel is formed in said free end of said post.

12. A portable self-supporting post assembly as defined in claim 11, further comprising a loop attached to said post at a location between said free end thereof and said base plate.

13. A portable post anchor comprising:

a substantially flat base plate having a top surface, a bottom surface and side edges, including an inside edge and an opposite outside edge, circumscribing said top and bottom surfaces;

a post fitting fastened to said base plate and extending upwardly from said top surface of said base plate at a location adjacent said inside edge which is substantially closer to said inside edge than said outside edge; and a resilient prong having a lateral cross-section of substantially greater width than thickness, said prong having at least one free first end adapted to penetrate a support surface and a second end rigidly fastened to said base plate at a location displaced a finite distance in an outward direction along the plane of said base plate from the location of said post fitting, said prong being oriented with its width generally transverse to said outward direction and extending longitudinally downwardly from said bottom surface of said base plate and curving smoothly outwardly along a substantial portion of its length so that said free first end thereof extends downwardly and away from the location of said post fitting.

14. A portable post anchor as defined in claim 13, wherein said prong is formed of flat spring metal.

15. A portable post anchor as defined in claim 14, wherein said second end of said prong is rigidly fastened to said outside edge of said base plate.

16. A portable post anchor as defined in claim 13, wherein two of said prongs are provided, and said second ends thereof are spaced from each other in a direction which is transverse to said outward direction.

17. A portable post anchor as defined in claim 16, wherein said prongs are formed of flat spring metal.

18. A portable post anchor as defined in claim 17, wherein said second ends of said prongs are rigidly fastened to said outside edge of said base plate.

19. A portable post anchor as defined in claim 18, wherein said second ends of said prongs are equidistant from said post fitting.

20. A portable post anchor as defined in claim 17, wherein said post fitting is an upwardly open socket.

* * * * *